United States Patent [19]

Khimenko et al.

[11] 4,067,216

[45] Jan. 10, 1978

[54] INDUCTOR FOR MAGNETIC PULSE SHAPING OF METALS

[76] Inventors: Lev Timofeevich Khimenko, poselok Pokotilovka, ulitsa Ulyanovskaya, 35; Evgeny Nikolaevich Degtyarev, ulitsa Pushkina, 79, kv. 25; Mikhail Ivanovich Baranov, ulitsa Galana, 3, kv. 30, all of Kharkov; Anatoly Vasilievich Legeza, ulitsa Sportivnaya, 19a, kv. 26, Merefa Kharkovskoi oblasti; Alexandr Tikhonovich Mezhuev, ulitsa Dneprovskaya, 19, kv. 7, Kharkov, all of U.S.S.R.

[21] Appl. No.: 676,398

[22] Filed: Apr. 12, 1976

[51] Int. Cl.[2] ..... B21D 26/02

[52] U.S. Cl. ..... 72/56; 72/DIG. 26; 29/421 M

[58] Field of Search ..... 72/54, 56, 62, DIG. 26; 29/421 M

[56] References Cited

U.S. PATENT DOCUMENTS

| | | | |
|---|---|---|---|
| 3,345,844 | 10/1967 | Jansen et al. | 72/56 |
| 3,823,589 | 7/1974 | Tikhonovich | 72/56 |
| 3,842,630 | 10/1974 | Mikhailovich | 72/56 |
| 3,921,426 | 11/1975 | Bely et al. | 72/56 |

FOREIGN PATENT DOCUMENTS

| | | |
|---|---|---|
| 1,462,863 | 11/1966 | France. |

*Primary Examiner*—Leon Gilden

*Attorney, Agent, or Firm*—Lackenbach, Lilling & Siegel

[57] ABSTRACT

Disclosure is made of an inductor for magnetic pulse shaping of metals, wherein on the outer surface of a concentrator, having a radial slot and an opening to receive an article being worked, there are provided flutes with windings disposed therein; in the radial slot zone, the concentrator ribs are provided with rectangular-shaped grooves whose depth is equal to that of the flutes, said grooves extending perpendicularly to the plane of the radial slot and receiving electrically conducting segment-shaped inserts overlapping the radial slot and insulated from the concentrator by gaskets.

2 Claims, 2 Drawing Figures

INDUCTOR FOR MAGNETIC PULSE SHAPING OF METALS

The present invention relates to the shaping of metals by using the pressure of a pulsating magnetic field and, more particularly, to inductors for magnetic pulse shaping of metals.

The invention is applicable in machine building and metal working for roughing, pressing, welding, expanding and beading tubular articles, as well as for flanging, punching, straightening and sizing electrically conducting flat articles.

An important problem facing designers of inductors for magnetic pulse shaping of metals is to ensure adequate mechanical strength of inductors. This is due to enormous electrodynamic loads acting upon the electrically conducting working components of an inductor, which tend to destroy the latter.

There is known an inductor for magnetic pulse working of metals, which comprises a concentrator with a radial slot and an axial opening to receive an article being worked, a winding disposed in flutes provided on the external surface of the concentrator, and electrically conducting inserts overlapping the radial slot, insulated from the concentrator and disposed in radial holes provided in the plane of the radial slot on both sides of each flute, the depth of said holes being equal to that of the flutes.

As pulse current flows through the winding of the known inductor for magnetic pulse shaping of metals, there is produced an axially directed magnetic flux in the insulation gap between the walls of the concentrator's radial slot. This flux tends to spread to all the turns of the inductor's winding. The known inductor under review is disadvantageous in that it lacks adequate screening, the radial slot zone, of turns laid in the adjoining flutes of the concentrator, because the axially directed magnetic flux penetrates to the turns in the adjoining flutes through the insulation gaps between the inserts and the walls of the radial openings. According to the laws of electrodynamics, this brings about unbalanced axial and radial electrodynamic forces which act upon the turns of the winding in the zone of the concentrator's radial slot, whereby the winding's electric insulation is damaged and the inductor's service life is reduced.

It is an object of the present invention to eliminate the above disadvantages.

The invention essentially aims at providing an inductor for magnetic pulse shaping of metals, possessing high mechanical strength due to reduced axial and radial electrodynamic loads acting upon the winding in the radial slot zone.

The foregoing object is attained by providing an inductor for magnetic pulse shaping of metals, comprising a concentrator having a radial slot and an axial opening to receive an article to be worked, said concentrator also having circumferential annular flutes on the outer surface thereof which are axially spaced from each other to form annular ribs, a winding laid in said flutes, and electrically conducting inserts overlapping or bridging the radial slot, insulated from the concentrator and disposed in the concentrator's ribs at a depth of the flutes in the radial slot zone, in which inductor the ribs of the concentrator are provided, according to the invention, with rectangular-shaped grooves arranged perpendicularly to the plane of the radial slot, said grooves being intended to receive said segment-shaped inserts.

The foregoing design makes it possible to practically rule out the action of axial and radial electrodynamic forces upon the winding in the radial slot zone and thus substantially raise the durability and prolong the service life of the inductor in terms of the number of metal working operations carried out without impairing the electric insulation of the winding.

Other objects and advantages of the present invention will become more apparent from the following detailed description of a preferred embodiment thereof taken in conjunction with the accompanying drawings, wherein.

Figure 1:
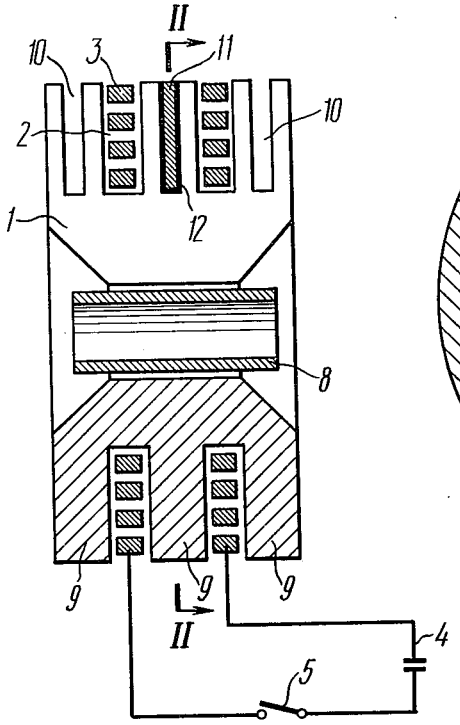
FIG. 1 shows an inductor for magnetic pulse shaping of metals and circuitry for connecting said inductor to a power source.
Figure 2:
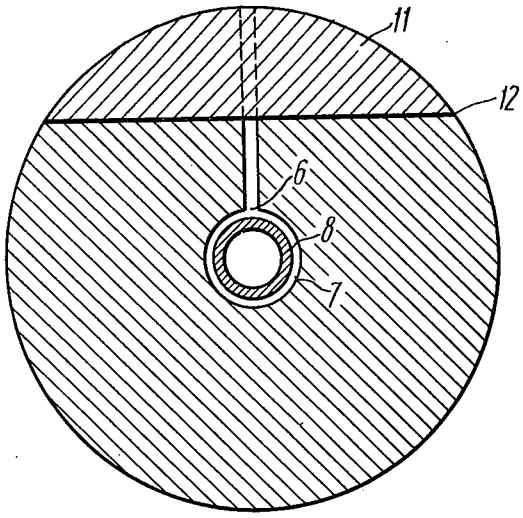
FIG. 2 shows a concentrator with an insert (a sectional view taken along the line II—II of FIG. 1).

Referring now to the attached drawings, the proposed inductor for magnetic pulse shaping of metals (FIG. 1) comprises a magnetic field concentrator 1 on whose outer surface there are annular flutes 2 wherein there is laid a winding 3 electrically connected to a capacitor bank 4 via a switching means 5. The internal surfaces of the flutes 2 are connected through those of a radial slot 6 (FIG. 2) to the working surface of an opening 7 of the concentrator 1, wherein there is received an article 8 to be worked. The body of the concentrator 1 between the annular flutes 2 on one side and the butt end surfaces of the concentrator 1 and flutes 2 on the other side forms ribs 9 (FIG. 1) of the concentrator 1. In the ribs 9, in the zone of the radial slot 6, provision is made for grooves 10 whose depth is equal to that of the flutes 2. The grooves 10 are rectangular in cross-section and extend perpendicularly to the plane of the radial slot 6. The rectangular grooves 10 receive segment-shaped, electrically conducting inserts 11. The electrically conducting inserts 11 are separated from the concentrator 1 by insulation gaskets 12 of polyfluoroethylene or polyethyleneterephthalate.

The proposed inductor for magnetic pulse shaping of metals operates as follows.

As the switching means 5 is brought into action, the capacitor bank 4 discharges into the winding 3. Pulse current, that flows through the winding 3, induces eddy currents in the walls of the flutes 2, which are concentrated, through the radial slot 6, on the working surface of the opening 7 of the concentrator 1. The current in the opening 7, in turn, induces eddy currents in the article 8 being worked. Interaction between these currents and the current in the opening 7 brings about deformation of the article 8. In the radial slot 6, the magnetic flux is concentrated in the insulation gap between the inserts 11 and the turns of the winding 3; as a result, the magnetic lines of the turns of the winding 3 in the adjoining flutes 2 are disconnected. This reduces the axial electrodynamic forces acting upon the turns of the winding 3 in the adjoining flutes 2. Besides, the inserts 11 weaken the total magnetic flux in the radial slot 6 in the zone of the respective flutes 2, which, in turn, reduces the radial electrodynamic forces acting upon the winding 3 in the zone of the radial slot 6 of the concentrator 1.

Thus, the proposed inductor for magnetic pulse shaping of metals practically eliminates the effects of radial and axial electrodynamic forces upon the winding 3 in the zone of the radial slot 6 of the concentrator 1, which considerably improves the durability and prolongs the service life of the inductor.

What is claimed is:

1. An inductor for magnetic pulse shaping of metals, comprising a concentrator having a radial slot and an axial opening to receive an article to be worked, said concentrator also having circumferential annular flutes on the outer surface thereof which are axially spaced from each other to form annular ribs; a winding laid in said flutes; rectangular-shaped grooves provided in said ribs of said concentrator, the depth of said grooves being equal to that of said flutes, said grooves extending perpendicularly to the plane of said radial slot; and electrically conducting, segment-shaped inserts disposed in said grooves, insulated from said concentrator and overlapping or bridging said radial slot, said inserts being generally coextensive with the outer peripheral surface of said concentrator, whereby the electromagnetic fields of the coils of said winding are significantly shielded to thereby reduce the magnetic flux in said radial slot between said winding coils and decrease the axial and radial electrodynamic forces acting on the turns of said winding.

2. An inductor as defined in claim 1, wherein two annular flutes are provided to form three annular ribs.

* * * * *